US011008821B1

(12) United States Patent
Steger et al.

(10) Patent No.: US 11,008,821 B1
(45) Date of Patent: May 18, 2021

(54) WEIGHT MATERIAL RECOVERY AND REUSE METHOD FROM DRILLING WASTE

(71) Applicant: RECOVER ENERGY SERVICES INC., Calgary (CA)

(72) Inventors: Greg Steger, Calgary (CA); Brian Coston, Calgary (CA); Stan Ross, Cochrane (CA)

(73) Assignee: RECOVER ENERGY SERVICES INC., Calgary (CA)

( * ) Notice: Subject to any disclaimer, the term of this patent is extended or adjusted under 35 U.S.C. 154(b) by 0 days.

(21) Appl. No.: 16/327,578

(22) PCT Filed: Aug. 24, 2017

(86) PCT No.: PCT/IB2017/055112
§ 371 (c)(1),
(2) Date: Feb. 22, 2019

(87) PCT Pub. No.: WO2018/037374
PCT Pub. Date: Mar. 1, 2018

Related U.S. Application Data

(60) Provisional application No. 62/379,437, filed on Aug. 25, 2016.

(51) Int. Cl.
*E21B 21/06* (2006.01)
*B07C 5/04* (2006.01)

(52) U.S. Cl.
CPC ..... *E21B 21/065* (2013.01); *B07C 5/04* (2013.01)

(58) Field of Classification Search
CPC ..... E21B 21/065; B07C 5/04
(Continued)

(56) References Cited

U.S. PATENT DOCUMENTS 4,222,988 A 9/1980 Barthel
5,454,957 A * 10/1995 Roff, Jr. ..... E21B 21/063 210/768

(Continued)

FOREIGN PATENT DOCUMENTS

| | | |
|---|---|---|
| CA | 1310144 | 10/1987 |
| CA | 2260714 | 8/1999 |
| CA | 2609851 | 5/2008 |

OTHER PUBLICATIONS

Mi Swaco ( A Schumberger Company), "M-I Wate-4.1 SG Barite", retrieved on Oct. 27, 2017, from Internet <URL:http://www.slb.com/~/media/Files/miswaco/ps-drilling-fluids/m-i_wate_barite.ashx> , ., pp. 1-3.

(Continued)

*Primary Examiner* — Nam X Nguyen
*Assistant Examiner* — Julia L. Wun
(74) *Attorney, Agent, or Firm* — Greenblum & Bernstein, P.L.C.

(57) ABSTRACT

A process for recovering weight material for reuse in drilling fluids from a previously unavailable source of feed stock. The process described herein includes a process of cleaning drilling waste through either low temperature thermal or solvent washing to remove hydrocarbon or water based drilling fluid contamination. The cleaned drilling waste, substantially free of liquids is sifted and the bulk fraction is further treated by employing conventional separation technology to recover a high gravity solids phase while discarding low gravity solids phase as tailings. Additionally, described is a process where the recovered high gravity solids phase can be reused as a high density weight material, or lower cost weight material, either of which is desirable to the drilling of modern oil and gas wells. The process of adding drilling fluid back into the recovered weight material (Continued)

Dry Barite Recovery Process Flow Diagram to simplify the process of transporting the weight material into an active drilling fluid system is also described.

8 Claims, 4 Drawing Sheets

(58) Field of Classification Search
USPC ..... 210/767, 787, 800
See application file for complete search history.

(56) References Cited

U.S. PATENT DOCUMENTS

| | | | |
|---|---|---|---|
| 6,073,709 | A | 6/2000 | Hensley |
| 7,396,433 | B2 | 7/2008 | Strand |
| 8,820,438 | B2 | 9/2014 | Ross et al. |
| 2004/0094483 | A1 | 5/2004 | Mueller |
| 2011/0017675 | A1 | 1/2011 | Larson |

OTHER PUBLICATIONS

Official Communication issued in International Bureau of WIPO Patent Application No. PCT/IB2017/055112, dated Nov. 20, 2017.

* cited by examiner

Typical (Barite) Mine Process Flow Diagram

WEIGHT MATERIAL RECOVERY AND REUSE METHOD FROM DRILLING WASTE

CROSS-REFERENCE TO RELATED APPLICATION

The instant application is an International Application claiming the benefit of U.S. provisional application No. 62/379,437 filed on Aug. 25, 2016, the disclosure of which is hereby expressly incorporated by reference thereto in its entirety.

TECHNICAL FIELD

The field of art to which this invention generally pertains is the management of drilling fluids, specifically the effective separation of the liquid and solid phases.

BACKGROUND

During the drilling of a well, for example for gas or oil, drilling mud is typically pumped down the drill string through a drill bit. The drilling mud simultaneously cools the bit and carries drill cuttings up the well bore. Drilling mud is typically comprised of a fluid (or fluids), and mixture of additives which can be either fluids or solids, forming a useable drilling fluid.

Typically, the drill cuttings which are carried up the wellbore are subjected to solids separating devices when the cuttings exit the wellbore, such as that of shale shakers or decanter centrifuges. These mechanical separators allow a substantial portion of the drilling mud to be returned to the storage tanks for reuse, while the drill cuttings portion is sent to separate storage tanks.

The drilling mud is a very important aspect of drilling safety and efficiency. "Mud checks" are typically performed daily to monitor density, rheology, viscosity, low gravity solids accumulations, among other parameters. Conditioning or drilling mud rehabilitation is subsequently ordered, to maintain or enhance the drilling mud performance.

With the evolution of new drilling technologies such as horizontal drilling, shale oil or shale gas fracking, and the increasing cost of drilling fluids, the ability to, and benefits of, recovering or enhancing drilling fluid or additives would have clear benefits.

Accordingly, there is a constant search for new technologies and improvements to existing technologies to increase the efficiency and effectiveness of reclaiming and recycling processes.

BRIEF SUMMARY

A process of weight material recovery is described, including collecting cleaned solids waste from a drilling waste treatment process, removing substantially all particles greater than 75 microns from the cleaned solids weight material contained therein, and separating the cleaned solids weight material by specific gravity segregation at least once to produce a first solids phase weight material with a first density and at least one additional solids phase with a second density lower than the density of the first solids phase, and recovering the first solids phase weight material resulting in recovered weight material particularly adapted for use as a drilling mud additive in water or oil based drilling fluid systems.

Additional embodiments include: the process described above where the collected cleaned solids weight material is collected from a low temperature thermal drilling waste treatment process and contains residual hydrocarbon contamination of less than 3% by weight; the process described above where the collected cleaned solids weight material is collected from a diluent washing and drying process and contains residual hydrocarbon contamination of less than 3% by weight; the process described above where the collected cleaned solids weight material comprises a mixture of barite and lower gravity solids; the process described above where the collected cleaned solids weight material additionally contains less than 0.5% hematite by weight; the process described above where the recovered weight material has a specific gravity of greater than 3.5; the process described above where the recovered weight material has a specific gravity of greater than 4.0; the process described above where the recovered weight material has a specific gravity of greater than 4.1; the process described above where the recovered weight material has a specific gravity of greater than 4.2; the process described above where the collected clean solids weight material is a mixture of hematite and lower gravity solids; the process described above where the recovered weight material has a specific gravity of greater than 4.0; the process described above where the recovered weight material has a specific gravity of greater than 4.5; the process described above where the recovered weight material has a specific gravity of greater than 4.8; the process described above where the recovered weight material has a specific gravity of greater than 5.0; the process described above where the recovered weight material has a specific gravity of greater than 5.1; the process described above where the recovered weight material has a specific gravity of greater than 5.2; the process described above where the recovered weight material comprises a mixture of barite and hematite and low gravity solids; the process described above where the recovered weight material has a specific gravity of greater than 3.8; the process described above where the recovered weight material has a specific gravity of greater than 3.9; the process described above where the recovered weight material has a specific gravity of greater than 4.0; the process described above where the recovered weight material has a specific gravity of greater than 4.1; the process described above where the recovered weight material has a specific gravity of greater than 4.2; the process described above where hematite is added to the recovered weight material prior to reuse as a weighting agent in a drilling fluid system, and the hematite makes up less than 10% by weight of the overall specific gravity of the weighting agent; the process described above where a mineral with a specific gravity of greater than 4.3 is added to the recovered weight material until the mixture of recovered weight material and the added mineral have a combined specific gravity of greater than 4.0, prior to reuse as a weighting agent in a drilling fluid system; and the process described above where the mineral is high grade barite.

A process for weight material recovery is also described including collecting cleaned solids waste containing less than 3% residual hydrocarbons by weight from a drilling waste treatment process and separating the cleaned solids weight material by specific gravity segregation at least once to produce a first solids phase weight material with a first density and at least one additional solids phase with a second density lower than the density of the first solids phase, and recovering the first solids phase weight material, resulting in recovered weight material particularly adapted for use as a drilling mud additive in water or oil based drilling fluid systems.

Additional embodiments include: the process described above where the drilling waste treatment process is a low temperature thermal process; the process described above where the drilling waste treatment process is a diluent washing and drying process; the process described above where the weight material is a mixture of barite and at least a portion comprising lower gravity solids; the process described above where the recovered weight material phase has a specific gravity of greater than 3.5; the process described above where the weight material is a mixture of hematite and at least a portion comprising lower gravity solids; the process described above where the recovered weight material phase has a specific gravity of greater than 4.0; the process described above where the weight material is a mixture of barite and hematite and lower gravity solids; and the process described above where the recovered weight material phase has a specific gravity of greater than 3.8.

A process for weight material recovery is also described including collecting cleaned solids waste from a drilling waste treatment process and separating the cleaned solids weight material by specific gravity segregation at least once to produce a first solids phase weight material comprising a combined first solids phase mixture of barite and lower gravity solids particularly adapted for reuse as a drilling fluid additive and, at least one additional combined solids phase mixture with a lower density than the first phase and which is not particularly adapted for reuse as weight material in a drilling fluid system and, adding hematite to the combined first solids phase mixture of barite and lower gravity solids prior to reuse as a drilling mud additive in a water based drilling fluid system or oil based drilling fluid system, said hematite added to the first phase resulting in a concentration of the hematite in the first phase greater than 1.0% by weight.

A process for weight material recovery is also described including collecting cleaned solids waste in substantially dry form from a drilling waste treatment process, removing substantially all particles greater than 75 microns from the cleaned solids weight material contained therein, and separating the cleaned solids weight material by specific gravity segregation at least once to produce a first solids phase weight material with a first density and at least one additional solids phase with a second density lower than the density of the first solids phase, recovering the first solids phase weight material, and mixing the first phase with a liquid to form a paste material particularly adapted for use as a drilling mud additive in water or oil based drilling fluid systems.

Additional embodiments include: the process described above where the liquid comprises water and/or water base mud, or oil and/or oil base mud, which can be pumped, mechanically conveyed or conveyed using air pressure to an end user; the process described above where the liquid is added to the first phase at a volumetric ratio of greater than one part liquid to less than nine parts dry, clean first phase recovered weight material; the process described above where the paste is a uniformly consistent paste and is used as a weighting agent in an active mud system.

These and additional embodiments are further described below.

DETAILED DESCRIPTION

Figure 1:
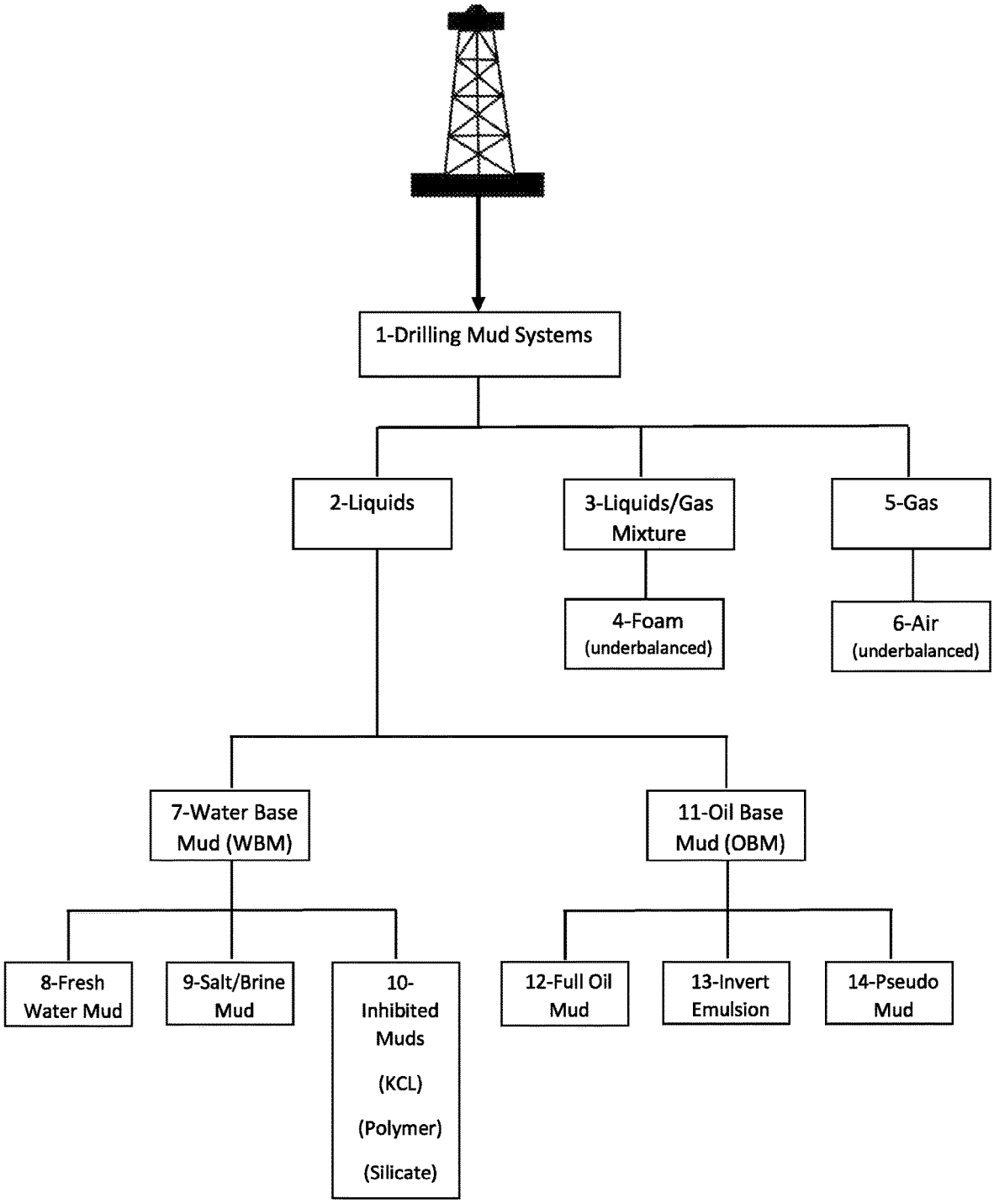
FIG. 1 is a flow chart of different mud systems used while drilling.

The particulars shown herein are by way of example and for purposes of illustrative discussion of the various embodiments of the present invention only and are presented in the cause of providing what is believed to be the most useful and readily understood description of the principles and conceptual aspects of the invention. In this regard, no attempt is made to show details of the invention in more detail than is necessary for a fundamental understanding of the invention, the description making apparent to those skilled in the art how the several forms of the invention may be embodied in practice.

The present invention will now be described by reference to more detailed embodiments. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise. All publications, patent applications, patents, and other references mentioned herein are expressly incorporated by reference in their entirety.

Unless otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should be construed in light of the number of significant digits and ordinary rounding approaches.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Every numerical range given throughout this specification will include every narrower numerical range that falls within such broader numerical range, as if such narrower numerical ranges were all expressly written herein.

Additional advantages of the invention will be set forth in part in the description which follows, and in part will be obvious from the description, or may be learned by practice of the invention. It is to be understood that both the foregoing general description and the following detailed description are exemplary and explanatory only and are not restrictive of the invention, as claimed.

A process for recovering weight material for reuse in drilling fluids from a previously unavailable source of feed stock is described herein. The process describes cleaning drilling waste through either low temperature thermal or solvent washing to remove hydrocarbon or water based drilling fluid contamination. The cleaned drilling waste, substantially free of hydrocarbons or water based contamination is then sifted and the bulk dry volume is further treated by employing conventional separation technology to recover a high purity—high gravity solids phase while discarding low gravity solids phase as tailings. The process further describes reusing the recovered high gravity solids phase as a high purity weight material, or lower cost weight material, either of which is desirable to the drilling of modern oil and gas wells. In another embodiment, the process of enhancing the recovered weight material with other weighting agents to artificially but deliberately cause the specific gravity to be higher, or add drilling fluid back into the recovered weight material to simplify the process of transporting the weight material into an active drilling fluid system is also described.

The following terminology is included for ease of understanding:

Drilling fluid—used in the drilling industry to carry the solids phase (rock, clay, shale, etc.) broken up by the drill bit out of the well bore so that it can be discarded as drilling waste. Drilling fluid (or drilling mud) consists of a base fluid with additives which can include liquids or solids or both, which give the drilling fluid properties necessary for effective use as a drilling fluid.

Low Gravity Solids—(LGS) are typically less than 20 microns in size and generally have a specific gravity of less than 2.5 and consist of drilling mud additives or formation solids. Formation solids begin as larger drill cutting pieces for example, as large as 2 centimeters in diameter, of which a portion of the larger pieces become broken or ground down to less than 20 microns by the time they arrive at surface.

High Gravity Solids—(HGS) are typically less than 20 microns in size and generally have a specific gravity of greater than 3.5 and consist of weight material or weighting agents. Hematite and barite are both used as weight material in North America, with barite being the most common due to cost and availability. Weight material is used to increase the density of the drilling fluid, to keep high formation pressures under control while drilling.

Oil based mud—(OBM) also known as Invert, is a type of drilling fluid that uses oil as the base ingredient and it typically consists of a mixture of oil, emulsified water and drilling mud additives which might be solids or liquids or both.

Water based mud—(WBM) is a drilling fluid that uses water as the base ingredient, mixed with liquids or solids or both. Common water base muds are known as gel-chem mud systems, brine mud systems or polymer mud systems.

During the drilling of a gas or oil well, drilling mud is typically pumped down the drill string through a drill bit to simultaneously cool the bit and carry drill cuttings up the well bore. Drilling mud is typically comprised of a fluid (or fluids), and mixture of additives which can be either fluids or solids, forming a useable drilling fluid.

The drilling mud comprising the active mud system is a very important aspect of a safe and efficient drilling operation. "Mud checks" are typically completed daily to monitor density, rheology, viscosity, low gravity solids accumulations, among other parameters. Conditioning or drilling mud rehabilitation is subsequently ordered, to maintain or enhance the drilling mud performance.

As illustrated in FIG. 1, there are many types of drilling mud systems (1), including many types of drilling fluids including liquids (2), liquid/gas mixtures (3), including foam (4) and gas (5), including air (6). The liquids include water based muds (7) including fresh water muds (8), salt (brine) muds (9), and inhibited muds (10) such as KCl (potassium chloride), polymer, and silicate. Liquids also include oil based muds (11) including full oil muds (12), invert muds (13), and pseudo muds (14), among others. The primary difference between drilling fluids is the base ingredient. Gas (or air) based systems are cost effective because (notwithstanding air is free), they allow for extremely fast drilling by blowing the drilled solids out of the well and allowing the drill bit to remain clear of debris. However, they are seldom used because the presence of formation liquids causes "air drilling" to immediately stop working. Water base drilling fluids are typically used for non-technical well profiles because the base product (water) is typically very inexpensive. However, most shales (or compact clays) are hydrophilic (meaning they absorb water as opposed to hydrophobic, meaning they reject water), so drilling with a water based product can cause problems for the well operator, leading to expensive downtime. While oil base drilling fluids can require a significant capital investment, they are often used to drill oil and gas wells because they have special characteristics that make them a better cooling/carrying fluid than other drilling muds. Additionally, such drilling muds may offer better wellbore stability and/or lubricity for the drill string in modern, horizontal wellbores.

With the significant cost of drilling muds, there has been a great deal of research and development to most effectively recover as much of the drilling mud as possible, by using solids separating devices or fluids rehabilitation devices. Onsite solids control systems include shale shakers, centrifugal dryers or centrifuges while offsite liquids recovery systems generally consist of thermal extraction systems or diluent washing systems.

Thermal drilling waste processors can be employed to remove hydrocarbon contaminants and generally they are grouped by two categories; thermal and low temperature thermal. Thermal processors typically combust the contaminant or in the case of sealed systems, vaporize the contaminant and then recondense the vapours to reclaim the liquids phase. Efforts have been made to make thermal processors more efficient such as that described in U.S. Pat. No. 4,222,988 where the process is run under a vacuum. Vacuum lowers the boiling point of the target constituent thereby reducing the energy consumed in the process. However, lowering the pressure requires that condensers be larger to accommodate the vapour velocity and typically the process is run in batches, as opposed to continuous processors. This can cause higher energy consumption or inefficiencies in throughput. Further, thermal processors have been known to cause hydrocarbon cracking which changes the molecular structure of the oil, sometimes causing the recondensed oil to be unusable in a drilling fluid system.

In an effort to overcome the operational challenges, and concerns of recovered oil quality when utilizing a thermal processor, Thermtec AS developed a low temperature continuous processor, commonly known as a Thermtec Cuttings Cleaner (TCC), or thermo-mechanical cuttings cleaner or low temp thermal (LTT) by those in the industry. U.S. Pat. No. 7,396,433 describes LTT technology in detail, which is considered to be very energy efficient (when compared to other thermal evaporators) because the energy loss can be negligible. The friction is caused when the OBM contaminated drill cuttings waste are conveyed to the inside surface of the stationary outer wall of the reactor. There, high-speed wear-resistant paddles are rotating with close clearance to the reactor wall. The solids within the drill cuttings waste become caught up and broken by the tight clearances between the high speed rotating paddles and the reactor wall. The friction causes the drill cuttings waste to become heated to the point where fluids flash evaporate. The water first vaporizes as steam (further heating the hydrocarbons), followed by the hydrocarbons, leaving the solids phase in the reactor until the solids are ejected from the process thereafter. The vapor, comprised of water, hydrocarbons (and dust) is moved through one or more heat exchangers to extract the heat energy wherein water, hydrocarbons (and dust) are collected for disposal or reuse.

Additional examples of an oil recovery process are demonstrated in commonly owned U.S. Pat. No. 8,820,438 and patent application Nos. 62/303,163, 62/303,169 and 62/303,172, the disclosures of which are incorporated by reference herein, wherein a solvent (better known as a diluent) washing process is employed to dissolve the oil on cuttings. The processes employ as little as a single gravity force or thousands of gravity forces, after which a drying process is used to recover residual diluent from the solids phase for reuse in the process. The oil and diluent mixture is clarified and sent to a distillation column or flash kettles for solvent recovery. Air is purged and prevented from entering the process by a blanket gas system in combination with seals and fluid legs. Oxygen analyzers are used to ensure that oxygen concentration in the vapour is well below the explosive limit. These processes are substantially less energy intensive than LTT (for example, 50% less energy intensive).

Regardless of the treatment process, suffice it to say both LTT or diluent washing/drying can recover virtually all hydrocarbon contamination while producing a substantially clean, dry drilling waste, which is important to the embodiment described herein.

A significant cost of the drilling fluid is the addition of weighting agents for example, barite or hematite. Weighting agents (or weight material) is added to increase the density of the drilling fluid in an effort to hold formation pressures at bay while drilling the well. The use of a drilling fluid with a density higher than pure water for example, is essential to well control because if the formation gasses or fluids are released when the drill bit penetrates the pressurized formation, the results could be environmentally catastrophic, harmful (if not fatal) to workers, or damage or destroy infrastructure.

During the drilling of a modern gas or oil well, it is common for operators to use a drilling fluid with a density (in kilograms per 1000 litres of drilling fluid) of 1050 to 1150 on shallower portions of the well, while increasing the density to 1400 on deeper horizontal sections of the well. In extremely high pressure formations, fluid density can be higher than 1800.

The volume of barite added to an active drilling fluid system to ready it for high pressure drilling can be substantial. Typically an operator would have 100 cubic meters of drilling fluid in the active mud system and to alter the density of the OBM from 900 to 1200 would require the addition of 44,000 kilograms of barite, which is delivered to the drill site in 40 kilogram bags (or 1,600 kilogram bulk bags). In addition, to maintain the density of the drilling fluid the operator could add as few as several hundred to as many as several thousand more bags of weight material. Weight material additions are required because weight material is continually lost during the drilling of the well to the well bore and drilling waste, ejected from the drilling fluid at the shale shaker(s) or horizontal decanter centrifuge(s).

Typically, the drill cuttings which are carried up the wellbore by the drilling mud are passed over a shale shaker(s) to recapture a substantial portion of the drilling mud. Shale shakers are considered the first line of defense on a drilling rig, for recapturing drilling fluid that would otherwise be lost to the drill cuttings. They are a highly effective mechanism for bulk liquids recovery and very inexpensive when compared to other conventional forms of solids control, like that of centrifuges for example. While all shale shakers operate on the same basic principal, they do come in a variety of models, which offer differing gravitational forces, coarse to very fine screen sizes, differing vibratory motions, and as few as one screen, or as many as four, on one or more screen bed elevations.

Shale shakers apply force, usually measured in terms of gravitational forces, ranging between four to eight times greater than earth's gravity. The principals behind a vibratory screen is to create a bed where the solids and liquids phase "bounce", causing the liquids phase to yield under the stresses of the gravity and shaker forces. The yield point is the point where the (Bingham Plastic) liquids phase transitions from behaving like a solid, to acting as a liquid. Acting as a liquid provides an opportunity for the liquids phase to be thrown from the solids phase, and drop through the low micron screen of the vibratory bed. The liquids phase can then be returned directly to a processing tank, or be collected in an attached hopper or hose, and redirected to another process such as that of centrifuges, hydro cyclones, or membranes, for further fluids rehabilitation. Additional fluids rehabilitation is required because conventional shale shakers are a good mechanism to remove a substantial amount of liquids from the solids. However, this fluid typically contains small micron, high or low gravity solids that would otherwise travel through the porosity of the vibratory screen, rather than be caught on the upper side of the screen with the larger solids. Typically, shale shakers are only effective at obtaining a drill cuttings dryness of 10% to 25% by weight.

Horizontal decanter centrifuges are commonly used to remove the low micron solids that otherwise pass through the shale shaker screens. A typical drill site decanter can exert gravitational forces in excess of 1000 times that of Earth's gravity, and as much as 3000 times Earth's gravity force. These forces are capable of removing substantial volumes of low gravity solids, also known as drilled solids, before the low micron/low gravity solids volume can accumulate and become problematic to the drilling operation. Decanters have many designs and operating parameters including shorter or longer beach lengths for example, or shallow or deeper weir settings to facilitate longer fluids retention or a dryer solids discharge. It is up to the designers and operators of the decanter to balance the operating parameters against the specific needs of the drill site.

Given the weight material added to the drilling fluid is a higher density than low gravity solids in the drilling fluid, removal of the undesired low gravity drilled solids is difficult. As such, barite recovery methods are often employed at the drill site to first remove the weight material in a horizontal decanter, then sending the now substantially lower density drilling fluid liquids phase to a second polishing horizontal decanter for low gravity drilled solids removal. The drilling fluid is now cleaner from the perspective of total solids loading so the high gravity weight material is next loaded back into the cleaner drilling fluid thereby returning the density to a safe operating value prior to reuse.

Examples of onsite barite recovery systems can be found in Canadian Patent No. 1310144 which is a frothing process, and Canadian Patent No. 2260714 which pertains to the process of centrifuging the HGS's in a first decanter, then centrifuging LGS's in a second decanter, then adding the HGS's back into the drilling fluid, like described above.

Figure 2:
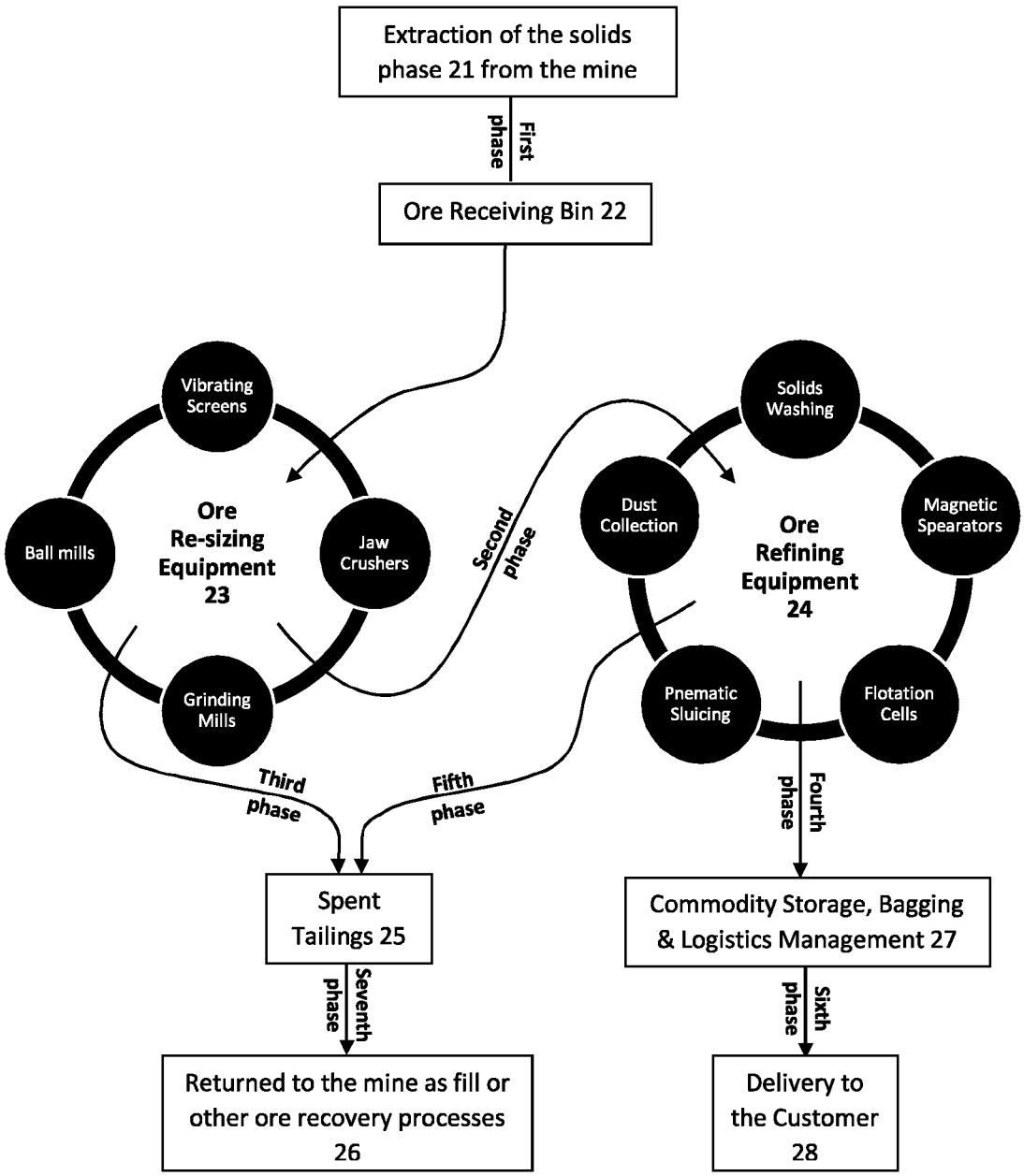
FIG. 2 is a typical flow chart for a weight material mine.

The most common weighting additive is barite, which is primarily mined in North America and Asia. The process of extraction is to blast or bore an ore rich seam to liberate the solids from the mine. As illustrated in FIG. 2, the first bulk rock phase (21) is transported to the processing facility where it is placed in an ore receiving bin (22). From there, the rock chunks are broken into a second phase of solids (23) by means of processing equipment which can include vibratory screens, jaw crushers, ball mills and grinding mills. Once the solids phase is resized to particles (typically) smaller than coarse sand, the second solids phase is moved to refining for particle segregation (24). Refining can consist of one or more process steps including magnetic separation, wash tanks, flotation cells or pneumatic sluicing. Pneumatic separation is preferred because of its lower energy requirements. The process of pneumatic sluicing consists of using air to transport the second solids phase into settling cells. High volume—low pressure air carries the second solids mixture into knockout tanks wherein the air flow slows temporarily and high gravity solids such as barite have an opportunity to drop out of the air stream whereas lower gravity solids for example, dolomite, lime and bentonite are light enough that they remain in the air stream because the airstream is still moving with sufficient velocity to carry the lighter solids. While the process can be repeated as many times as is necessary to produce a recovered mineral grade that meets the required marketing criteria, it's important to note that additional purification of the ore comes with an additional operating cost, or processing capacity, or capital cost for additional (or larger) equipment. The third solids phase (if any) is combined with the fifth solids phase to form a seventh solids phase consisting of a mixture of lower gravity solids (25). The seventh solids phase is processed to extract other constituents, or discarded as tailings waste and returned to the mine (26). Once the fourth phase is processed, it can be bagged or stored (27) in a bulk storage container for future distribution to the end user (28).

The business of quarrying is not typically a high margin business but rather, a business that operates on volume to generate a return on investment. Considering the act of processing barite, one must:

- Search for and obtain the mineral rights to a potential mine site;
- Confirm the volume of marketable material within the quarry, investigate regulatory compliance, quantify operating costs and identify a potential client to purchase the product;
- Build a business plan and raise necessary proceeds to create a viable business;
- Develop the process flow diagrams, complete detailed engineering, navigate regulatory compliance, and develop safe work procedures specific to the project;
- Order process equipment, clear overburden including foliage and earthen material, install utilities infrastructure, installation of housing accommodations for site workers and finally, installation of process equipment;
- Commission the mine and confirm the metrics of the process;
- Manage water resources to ensure water is used efficiently, manage tailings ponds to prevent an accidental release of contaminants to the environment and manage airborne emissions to ensure workers and the environment are not negatively impacted by the operation;
- Begin extracting ore and transport it to the quarry;
- Crush and process the ore to a manageable size distribution through one or more jaw crushers, vibrating screens and grinding mills and,
  - wash the ore which may occur in unison to specific gravity segregation by means of floatation cells, thereafter drying the refined mineral or,
  - wash and dry the ore and employ pneumatic sluicing to achieve specific gravity segregation;
- Bag the refined, commercially ready product;
- Manage logistics to ship the end product to the client.

Considering the complexity of regulatory and environmental compliance, it's easy to understand why new mine projects must be substantially large in size and scale to warrant an investment of time or money in resource extraction.

The North American supply of weight material has also been under pressure in the last decade due to the number of oil and gas wells being drilled. Other industries are also in need of high quality (high density) barite. When a process or industry requires high density barite for market compliance, the user is typically willing to pay higher prices. Additional refining at the mine can produce a higher density, but it also increases the cost of the ore. Given the highest density of ore will go to the user willing to pay the highest price, the spec of barite used in the oil and gas industry has had to be reduced from 4.2 to 4.1, and in some cases less than 4.0. The lower specific gravity of barite is caused by various impurities within the refined ore, which are cost prohibitive to remove. For example, as described in an MI Swaco brochure "M-I Wate—4.1 SG Barite" for the weight material Barium Sulphate, more commonly known as barite (the disclosure of which is herein incorporated by reference), MI Swaco markets "M-I Wate—4.1 SG Barite" consisting of about 87% barite (by weight) and about 13% impurities (by weight) which include, 0.1% Celestite, 10.9% Quartz, 0.3% Calcite, 0.5% Hematite and 1.3% Other Trace Components.

The use of a lower density weight material means drilling operations need to add additional weight material to achieve the desired drilling fluid density and as such, additional weight material of a lower density means a higher overall solids loading in the drilling fluid, typically resulting in decreased penetration rates while drilling or increased wear on pipe, hoses and seals.

Additional suppliers in China and India have come forward to pacify the ongoing need of barite by drilling companies in North America. However, the supplied spec and price of barite provided by India and China is often similar to the spec and price of North American suppliers. This is due to the same multifaceted industrial needs in those nations as what is seen in North America. While the cost of suppliers based in India or China are lower at the point of manufacturing/refining, when coupled with the obviously higher transportation costs to move a heavy ore across an ocean to reach North American markets results in a similar price point as that of local North American suppliers.

As described herein, the problems described and others in this area are addressed with the process and apparatus described herein. Thus, the scope of the process and apparatus shall include all modifications and variations that may fall within the scope of the attached claims. Other embodiments of the process and apparatus will be apparent to those skilled in the art from consideration of the specification and practice of the process and apparatus disclosed herein. It is intended that the specification and examples be considered as exemplary only.

With the advent of treatment technologies such as Low Temperature Thermal processors or solvent washing equipment, a previously unavailable source of lower cost weight material is available wherein the cleaned drilling waste is processed using a similar process as that of a barite mining operation, thereby offering the operator of a drilling waste cleaning facility a supply of lower cost weight material which can be marketed to drilling operators to satisfy the ongoing needs of the oil and gas industry.

Unstabilized drill cuttings samples were collected from two suppliers and processed using a solvent extraction technology. The cleaned drill cuttings were sent to a laboratory for independent third party testing which confirmed the amount of weight material present in each sample. An x-ray diffraction (XRD) analysis was completed to determine mineralogical composition.

In order to separate the particles less than three microns in size (the clay fraction) from the bulk fraction, the samples were treated in an ultrasonic bath using sodium metaphosphate as a deflocculating agent. The sample was then centrifuged in two phases. In the first phase, the sample was centrifuged at 600 rpm for 5 minutes that enable coarser particles to settle down at the bottom of the tube (these solids were placed back with the rest of bulk sample left in the beaker). The clay size particles remain in the fluid in suspension, which has been decanted to another tube and the clay size particles have been collected from this fluid after the second phase of centrifuging at 3000 rpm for 20 minutes (this is clay fraction). The weight fraction was calculated for both bulk and clay portions of this sample. Both the bulk and the clay fractions XRD was ran during this analysis.

As illustrated by Table 1, the total amount of weight material (barite—BaSO4) in the bulk fraction was 33% and 27% respectively. To a lessor extent, quartz, plagioclase feldspar, kaolinite, illite, siderite, calcite, dolomite, chlorite, (and in the case of the first sample T #1 Horizontal, trace mixed layer clays) made up the remainder of each sample.

TABLE 1

| Sample ID | Type of analysis | Whole (% weight) | Barite (% weight) |
|---|---|---|---|
| T#1-Horizontal | Bulk Fraction (>3 microns) | 95.43 | 34 |
| | Clay Fraction (<3 microns) | 4.57 | 15 |
| | Bulk & Clay Fractions | 100.0 | 33 |
| V#2-Vertical | Bulk Fraction | 91.82 | 29 |
| | Clay Fraction | 8.18 | 5 |
| | Bulk & Clay Fractions | 100.0 | 27 |

Suffice it to say, barite (or weight material in general), can make up a substantial portion of the drilling waste and given the volume of weight material present, and given the value weight material represents, the weight material component of cleaned drilling waste offers a substantial value add to recycling drilling waste.

Figure 3:
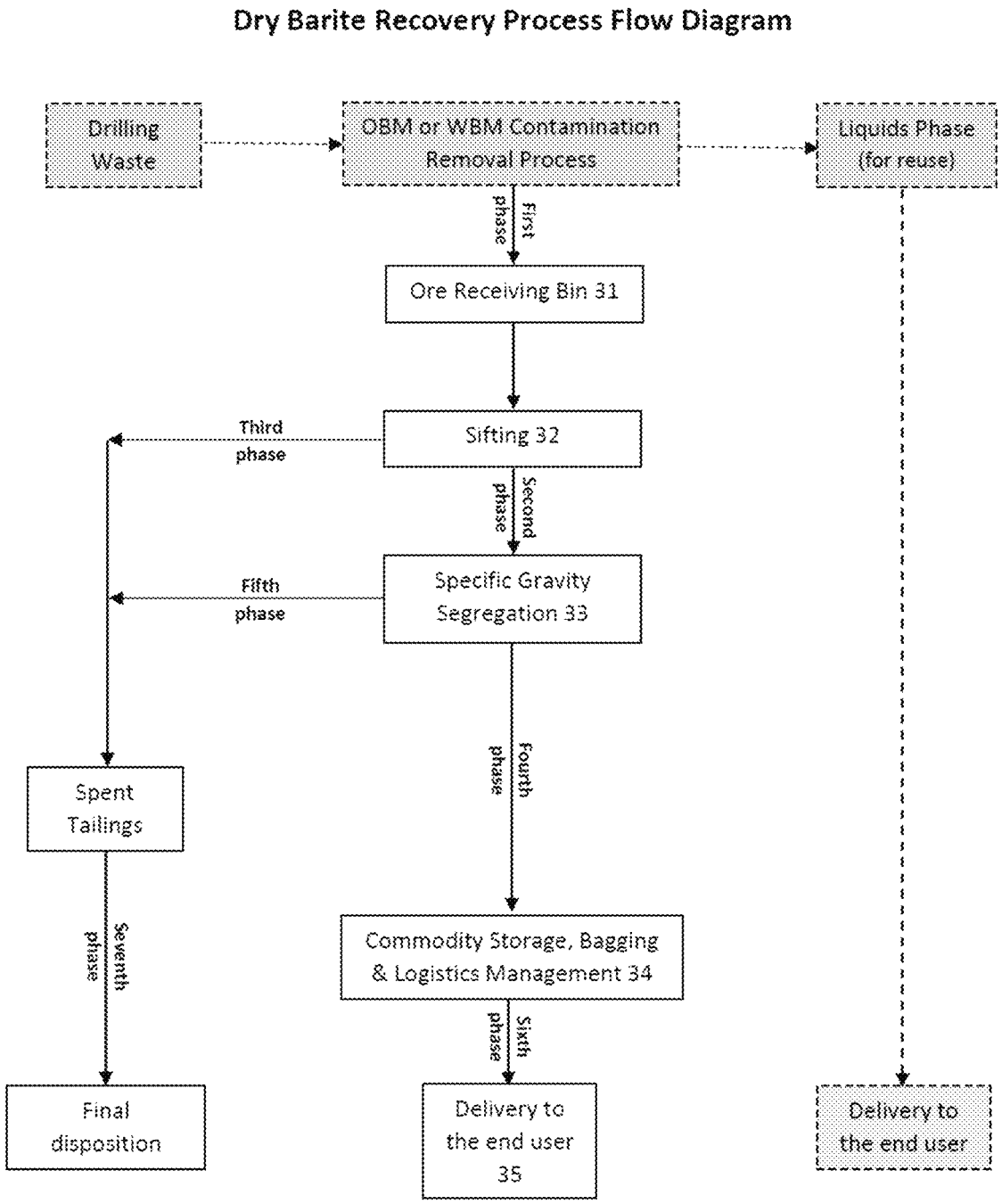
FIG. 3 is a flow chart for recovering and recycling weight material from a non-conventional source of feed stock.

FIG. 3 is included to demonstrate the process flow diagram of weight material recovery from an unconventional source such as LTT or diluent washing processes. As illustrated, the unstabilized drill cuttings treatment process is employed to produce a first phase of clean dry drilling waste solids (31) which is ideally first sifted (32) to produce the second phase weight material feed stock and a third phase of drilling waste pieces. Larger pieces, for example greater than about 75 microns are less desirable feedstock for the weight material recovery process because weight material added to a drilling fluid system is pre-refined to be less than 75 microns in size (and larger than 6 microns in size) and thus, any particles greater than 75 microns naturally can't be weight material. Given that sifting is an extremely low cost method of solids handling, the opportunity to remove a portion of the bulk fraction of feed stock at little cost is advantageous to the overall process of weight material recovery.

The second solids phase is next sent to the weight material recovery process which can be accomplished by one or more known technologies (33).

Once the fourth weight material phase is processed by specific gravity separators to the desired standard, it can be bagged or stored (34) in a bulk storage container for future distribution to the end user (35).

As mentioned above, barite is the most commonly used weighting agent in a drilling fluid due to cost and availability. However, if the recovered weight material is barite and the resulting specific gravity too low to meet the desired end user spec, it could be economically advantageous to enhance the recovered barite with at least a portion of a mineral with a specific gravity greater than 4.3, for example, purified barite, ilmenite or hematite, to increase the overall density of the recovered weight material, prior to distribution to the end user. As described in an MI Swaco brochure "Fer-Ox" for the weight material "Hematite" (the disclosure of which is herein incorporated by reference), more commonly known as hematite, the addition of hematite would not be less desirable to the end user because hematite is approximately 25% heavier than barite and thus, total solids loading will be less overall than even the purest supply of barite alone, while achieving the same (or higher) specific gravity than that of pure barite. For example, Table 2 illustrates the estimated cost of barite at different specific gravities (X being local currency units); the third column (e.g. 87% by weight barite) represents the typical weight material available to the drilling industry today.

TABLE 2

| | | | | | |
|---|---|---|---|---|---|
| Barite (4.4 SG) | 80% (by weight) | ~87% (by weight) | 100% (by weight) | | 80% (by weight) |
| Lower gravity solids (generally less than 3.0 SG) | 20% (by weight) | ~13% (by weight) | | | 15% (by weight) |
| Hematite | | | | 100% (by weight) | 5% (by weight) |
| Specific Gravity | less than 4.0 | 4.1 | 4.4 | 5.25 | 4.1 |

TABLE 2-continued

| | | | | | |
|---|---|---|---|---|---|
| Estimated retail price | ~0.75X (per 1000 kg's) | X (per 1000 kg's) | 1.35X (per 1000 kg's) | 3X (per 1000 kg's) | X (per 1000 kg's) |

Another, perhaps more desirable form of delivery of the recycled weight material is also proposed. Given there is likely to be some residual value in the form of wetting agents on the recovered weight material, and given the weight material has a propensity to become wet with the drilling fluid from where it was used as a weighting agent, to rewet the weight material with a small volume of base drilling fluid such as oil or water would be advantageous to product conveyance and quick acceptance by the industry for reuse.

While the process described within provides an opportunity to supply bagged weight material, or bulk bag weight material, or dry bulk weight material, another perhaps more desirable option is available. To wet the recovered dry bulk material with sufficient base fluid to create a paste would permit the weight material to be mechanically conveyed or conveyed using air pressure to push the weight material directly into the active drilling fluid system of the end user, the latter method being preferred due to a minimal effort requirement from the drilling operator.

A process to feed bulk weight material into an active drilling fluid system is also described herein, wherein the dry bulk material is dosed with a quantity of drilling fluid and thereafter mixed to create a uniform solids distribution with the liquids phase. This paste can be stored until needed without a concern of liquids leaching from the paste because insufficient liquids are present to become liberated. The point is to create a uniform paste, not a fluidic slurry (which can be prone to settling). While the exact volume of liquids phase to solids phase will be empirical, it is estimated that the volumetric ratio of liquids to solids will be greater than 1:9 respectively.

The addition of a lighter liquids phase will decrease the specific gravity of the paste. Given this is known in advance of marketing the weight material, efforts will need to be made to correct for the liquid to solids ratio when invoicing and communicating to the end user, what is actually being supplied for use as a weighting agent.

Once the paste is uniformly mixed it can be moved to a temporary storage vessel for storage. Ideally, this storage tank would be an elevated storage vessel. When required, it would be advantageous for a vacuum equipped tank truck, commonly known as a vac-truck to those in the industry to suck the paste from the elevated hopper tank and transport the paste to a drilling rig.

Figure 4:
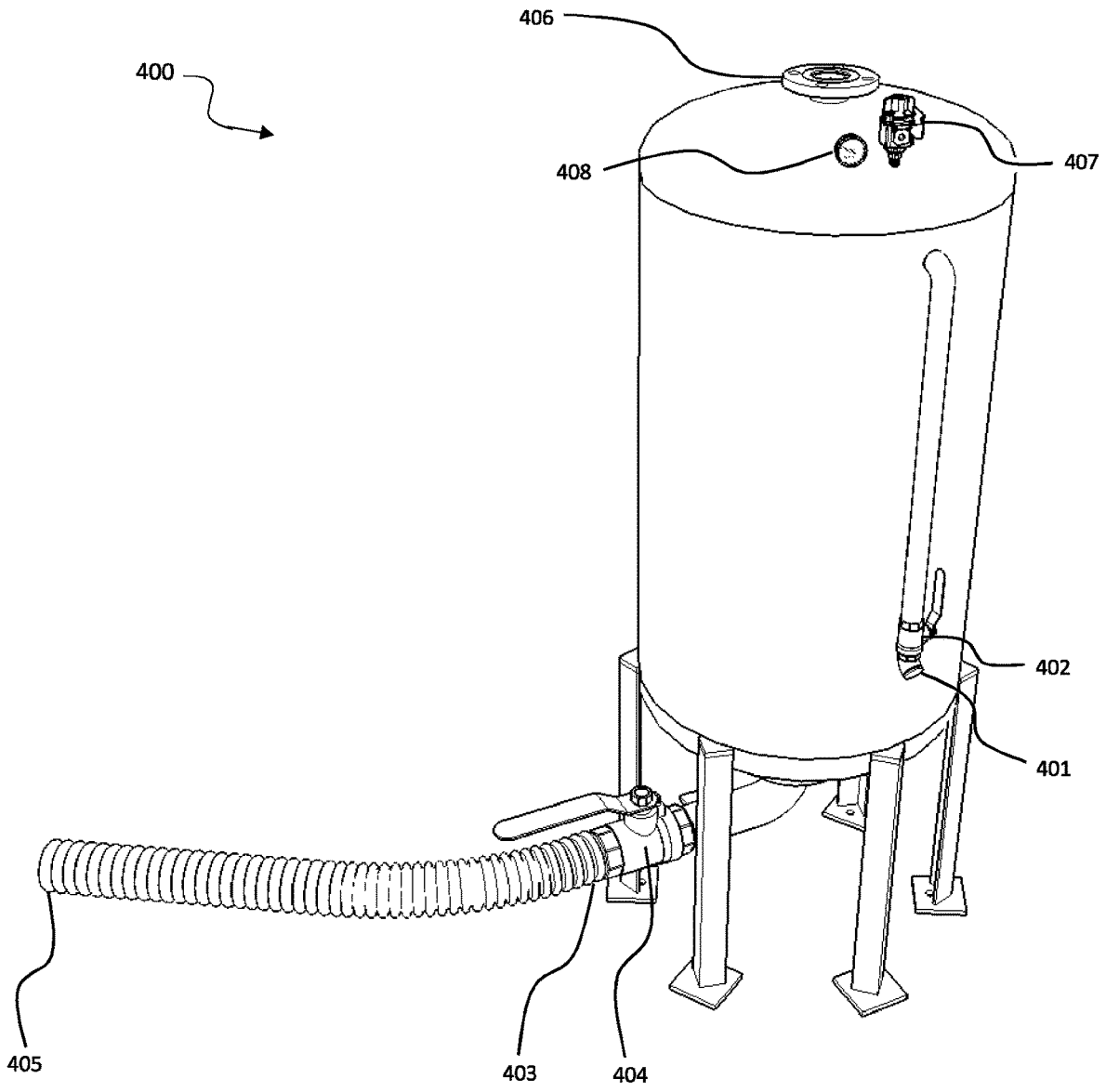
FIG. 4 depicts an embodiment of a temporary paste storage vessel as described herein.

As illustrated in FIG. 4, the vac-truck operator would next unload the weight material paste into a second similarly designed storage vessel (400) at the drill site by activating a compressor on the vacuum truck and pressurizing the transport vessel. The weight material paste would be pushed out of the transport vessel through a hose which is connected to an inlet (401) on the onsite storage vessel (400). The onsite storage vessel inlet is equipped with a valve (402) which would be opened to allow the weight material paste to enter the top half of the onsite storage vessel, and closed once the loading process is complete.

The onsite storage vessel would be operatively connected by means of conduit or flexible hose to the mud roll or other suitable port on the drilling rig. When the drilling rig operator is ready to mix the weight material paste into the active mud system, the first end of the high pressure hose (403) would be connected to the lower outlet valve (404) and the second end of the hose (405) would be connected to a suitable connection point on the drilling rig (not shown), such as the mud roll for example. An airline (not shown) would be connected to an open flange or threaded fitting (406) located nearest the top of the onsite storage vessel (400). Compressed air is supplied by an air compressor (not shown) on the drilling rig and independently monitored by the drilling rig operator. Compressed air would fill the upper atmosphere of the onsite storage vessel thereby pushing the weight material paste through the conduit or flexible hose to the active mud system where it is used to increase the density of the drilling fluid system. A density metering device, commonly known as a densometer (not shown), can be installed in a suitable location to calculate the exact volume of recycled weight material and/or drilling fluid added to the active mud system.

Given a typical air compressor is capable of supplying approximately 1000 kPa, the onsite storage vessel (400) should also be designed to safely accommodate the maximum working pressure of a typical air compressor and include typical pressure relief valve (407) and pressure indicating gauge (408).

Regardless of the method of delivery to the end user, the process described within has numerous benefits including:

Operational benefits for the end user including;

- a method of delivering pre-wetted weight material with a propensity to be invited into the drilling fluid would be a preferred method of weight material delivery; and,
- the process of delivering weight material in a paste form would alleviate the drilling rig operator from having to mix individual bags of weight material into the mud system over the course of hours or days; and,
- the location of a drilling waste treatment facility is most likely to be in close proximity to the drilling rig operator thereby creating a distribution centre for weight material which is substantially closer than industrial service centres or barite mines; and
- depending on the quality of weight material provided to the drilling rig operator, a higher density weight material is preferred over a lower weight material density because lower densities require additional solids loading in the drilling fluid system which reduces penetration rates and increases wear on seals, hoses and the drill string; and, Cost benefits for both the end user and the waste facility operator including;

- depending on the efficiency of the waste treatment process and ability to recover a high purity weight material, the operator is likely to see a cost reduction because the act of recovering weight material from a drilling waste is estimated to be lower than the process of discovering, developing and exploiting a mine; and,
- a lower liability for the operator of the drilling rig because not only is the volume of drilling waste being reduced through the method of drilling waste treatment, but at least a portion of the solids phase has been removed with a weight material recovery process thereby lowering the long term liability of the drilling waste delivered to an approved landfill for final disposition; and, a new revenue stream for the waste facility operator; and, lower operating costs due to approximately 25% of the clean drilling waste weight being diverted from landfill disposition and instead recycled, thereby reducing landfill tipping fees; and, Environmental benefits including:

a lower carbon foot print will be created by recycling weight material and removing transport/logistics from the process of supplying weight material to the oil and gas industry; and, landfill disposition is the method defined in some regulatory jurisdictions in North America. However, removing and recycling approximately 25% of the clean drilling waste as a drilling fluid additive will reduce the amount of waste destined for landfill disposition; and, the removal of the weight material portion of clean drilling waste could be advantageous to reusing the discarded phase as clean daily cover at a municipal landfill; and, removal of barite could be advantageous to new recycling initiatives because barium (an element within barite) in known as a heavy metal, which if liberated, is highly toxic to vegetation. Therefore, reusing clean drilling waste with high levels of barium could otherwise be limited by regulatory bodies.

While the drilling waste treatment processes described herein include exemplary thermal processors or solvent/diluent washing processors, recovered solids from other drilling waste treatment processes could also be used as the feed stock for weight material recovery, provided the drilling waste solids are of a similar consistency in size and residual impurities as those offered by thermal or solvent/diluent washing processors.

The methods and systems described herein meet the challenges described above, including, among other things, achieving more efficient and effective drilling waste processing. The scope of the invention shall include all modifications and variations that may fall within the scope of the attached claims. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A process of weight material recovery comprising, collecting cleaned solids waste material containing weight material and containing residual hydrocarbon contamination of less than 3% by weight from a thermal drilling waste treatment process, removing substantially all particles greater than 75 microns from said cleaned solids waste material, and separating the weight material contained in the cleaned 75 micron or smaller solids waste material by specific gravity segregation at least once to produce a first solids phase weight material with a first density and at least one additional solids phase weight material with a second density lower than the density of the first solids phase weight material, and recovering the first solids phase weight material, resulting in recovered first solids phase weight material adapted for use as a drilling mud additive in water or oil based drilling fluid systems.

2. The process of claim 1 wherein the collected cleaned solids waste material is collected from a diluent washing and drying process.

3. The process of claim 1 wherein the collected cleaned solids waste material comprises a mixture of barite and lower gravity solids.

4. The process of claim 1 wherein the collected clean solids waste material is a mixture of hematite and lower gravity solids.

5. The process of claim 1 wherein the recovered first solids phase weight material comprises a mixture of barite and hematite and low gravity solids.

6. The process of claim 1, wherein hematite is added to the recovered first solids phase weight material prior to use as a drilling mud additive in a drilling fluid system, and the hematite makes up less than 10% by weight of the overall specific gravity of the recovered first solids phase weight material after addition.

7. The process of claim 1, wherein a mineral with a specific gravity of greater than 4.3 is added to the recovered first solids phase weight material until the mixture of the recovered first solids phase weight material and the added mineral have a combined specific gravity of greater than 4.0, prior to use as a drilling mud additive in a drilling fluid system.

8. A process for weight material recovery, comprising collecting cleaned solids waste material containing weight material and containing residual hydrocarbon contamination of less than 3% by weight from a drilling waste treatment process, removing substantially all particles greater than 75 microns from said cleaned solids waste material, separating the weight material contained in the cleaned 75 micron or smaller solids waste material by specific gravity segregation at least once to produce a first solids phase weight material comprising a combined first solids phase mixture of barite and lower gravity solids adapted for use as a drilling fluid additive and, at least one additional combined solids phase mixture with a lower density than the combined first solids phase mixture and which is not adapted for use as a drilling fluid additive and, adding hematite to the combined first solids phase mixture of barite and lower gravity solids prior to reuse as a drilling mud additive in a water based drilling fluid system or oil based drilling fluid system, said hematite added to the combined first solids phase mixture resulting in a concentration of the hematite in the combined first solids phase mixture greater than 1.0% by weight.

* * * * *